US007465422B2

(12) United States Patent
Saarinen et al.

(10) Patent No.: US 7,465,422 B2
(45) Date of Patent: Dec. 16, 2008

(54) COOLING ELEMENT

(75) Inventors: Risto Saarinen, Niittykuja (FI); Eero Hugg, Kuukausikuja (FI); Kai Seppälä, Vilpunkatu (FI)

(73) Assignee: Outotec Oyi, Espoo (FI)

( * ) Notice: Subject to any disclaimer, the term of this patent is extended or adjusted under 35 U.S.C. 154(b) by 470 days.

(21) Appl. No.: 10/520,208

(22) PCT Filed: Jul. 17, 2003

(86) PCT No.: PCT/FI03/00571

§ 371 (c)(1),
(2), (4) Date: Dec. 28, 2004

(87) PCT Pub. No.: WO2004/011866

PCT Pub. Date: Feb. 5, 2004

(65) Prior Publication Data

US 2006/0049554 A1 Mar. 9, 2006

(30) Foreign Application Priority Data

Jul. 31, 2002 (FI) ..... 20021424

(51) Int. Cl.
*C21B 7/10* (2006.01)

(52) U.S. Cl. ..... 266/193; 266/194

(58) Field of Classification Search ..... 266/193, 266/194, 241; 122/6 A, 6 B; 373/76
See application file for complete search history.

(56) References Cited

U.S. PATENT DOCUMENTS

| | | | | |
|---|---|---|---|---|
| 4,382,585 | A * | 5/1983 | Fischer et al. | 266/190 |
| 4,437,651 | A * | 3/1984 | Cordier et al. | 266/193 |
| 5,251,882 | A * | 10/1993 | Kammerling et al. | 266/193 |
| 5,678,806 | A * | 10/1997 | Hille et al. | 266/193 |
| 5,904,893 | A * | 5/1999 | Stein | 266/46 |
| 6,470,958 | B1 * | 10/2002 | Solvi et al. | 164/465 |
| 6,641,777 | B1 * | 11/2003 | Kojo et al. | 266/193 |
| 6,843,958 | B1 * | 1/2005 | Korbik et al. | 266/194 |
| 6,911,176 | B2 * | 6/2005 | Saarinen | 266/193 |
| 2001/0054502 | A1 | 12/2001 | Hornschemeyer | 165/168 |

FOREIGN PATENT DOCUMENTS

| | | |
|---|---|---|
| GB | 2377008 | 12/2002 |

* cited by examiner

*Primary Examiner*—Kevin P Kerns
(74) *Attorney, Agent, or Firm*—Morgan & Finnegan, L.L.P.

(57) ABSTRACT

Disclosed is a method for manufacturing a cooling element (1) to be used in the structure of a furnace used in metal processes, such as a flash smelting furnace, a blast furnace, an electric furnace or other metallurgical reactor, the cooling element having a copper housing (2) made of one single piece, in which housing there is formed a channel system (3) for the circulation of the cooling medium, lining elements (4) made of fireproof material, the housing and lining element including means for connecting them together, and the lining element (4) and the housing (2) are connected so that the lining element (4) can move in the vertical direction with respect to the housing (2). Also disclosed is a cooling element.

18 Claims, 2 Drawing Sheets

COOLING ELEMENT

The invention relates to a method for manufacturing a cooling element and to a cooling element.

BACKGROUND OF THE INVENTION

In connection with industrial reactors, particularly reactors used in metal processes, such as flash smelting furnaces, furnaces and electric furnaces, there are used massive cooling elements that are usually made of copper. Typically cooling elements are water-cooled and thus provided with cooling water channel systems. In pyrometallurgical processes, the reactor brickworks are protected so that the heat directed to the brickwork surfaces is through the cooling element transferred to water, in which case the wearing of the lining is essentially reduced in comparison with a reactor that is not cooled. The reduction in wearing is achieved by a so-called autogenous lining solidified on the surface of the fireproof lining, which autogenous lining is formed of slag and other substances separated from the molten phases.

On the surface of the cooling element, there is often also arranged a ceramic lining, for instance of fireproof bricks. The working conditions prevailing in the reactor are extreme, and the cooling elements may be subjected for example to powerful corrosion and erosion strain caused by the furnace atmosphere and molten contacts. In order to achieve an effective operation for the cooling element, it is important that the junction between the fireproof bricks and the cooling element is a good one, so that an effective heat-transferring contact is obtained. However, the lining tends to thin out in the course of time, and this may result in a situation where the molten metal gets into contact with the surface of the cooling element made of copper.

The difficulty in the production of known cooling elements is to achieve a good contact between the fireproof lining and the cooling element. The protective effect of the fireproof lining is greatly dependent on a successful installation, and in most cases the cooling properties of the element cannot be fully utilized. Moreover, a drawback of known cooling elements is the fact that the grooves made for fastening the fireproof material are positioned horizontally in the furnace. Thus the motion caused by the thermal expansion of the supporting brickwork used in the furnace bottom, as well as the motion of the accretions accumulated of the solidifying molten phases on the furnace bottom cause tensions in linings located in the horizontal grooves, which may result in the shifting of the cooling element and the creation of harmful cracks. In addition, cooling elements made of several pieces contain a lot of horizontal seams where harmful leakages may occur.

The object of the present invention is to introduce a new solution for manufacturing a cooling element, as well as a cooling element. Another object of the invention is to realize a cooling element that has a good contact between the fireproof lining and the cooling element housing.

SUMMARY OF THE INVENTION

The solution according to the invention has many advantages, and by means of the invention, drawbacks of the prior art can be avoided. The structure of the cooling element according to the invention enables a good heat transfer between the housing comprising the cooling element and the lining made of fireproof material. The housing is preferably made of one single piece, so that seams in the structure are avoided. The housing and the lining elements are combined so that the fireproof lining elements may advantageously move with respect to the housing in the vertical direction. Now the tendency of the accretions located on the furnace bottom to move the whole cooling element is eliminated. On the surface of the housing, there are made vertical grooves, in which the lining elements made of fireproof material can be fitted owing to their bracket-like edge parts. A groove is preferably designed so that it narrows from the groove bottom towards the surface. This shape of the grooves helps the lining elements to be attached in the housing, and ensures that a good heat transfer is maintained between said surfaces. Advantageously the cooling element is installed in the furnace so that the grooves are positioned in the vertical direction. The bottom part of the housing provided in the cooling element is narrowed downwardly, in which case its shape preferably conforms to the shape of the supporting brick provided on the furnace bottom. Thus the effect of the motions caused by the thermal expansion of the supporting brick in the cooling element is attenuated.

The cooling element can be built as a ready-made structure already before it is installed in the furnace. As an alternative, the housing part and the lining elements can be built on site at the same time as the cooling element is installed in the furnace. The cooling element is easy and economical to manufacture, it is rapidly installed and thus it helps to cut down the time required by the furnace repairs. In the depth direction of the cooling element, the lining elements extend to outside the housing part, in which case they protect the cooling element structure better and thus reduce thermal losses in the furnace. Preferably the lining elements cover the whole surface of the housing, so that the copper surface of the cooling element does not get into contact with the melt. The cooling elements according to the invention are interconnected at the junctions provided in the elements, so that in an auxiliary groove formed in the junction, there are placed lining elements in the vertical direction. Thus the seam is advantageously covered. In the cooling element according to the invention, there are avoided horizontal seams that could cause serious melt leakages. By employing the cooling element structure according to the invention, it is possible to avoid the use of a solder material between the housing and the lining.

The invention is described in more detail below with reference to the appended drawings.

DETAILED DESCRIPTION OF THE INVENTON

Figure 1B:
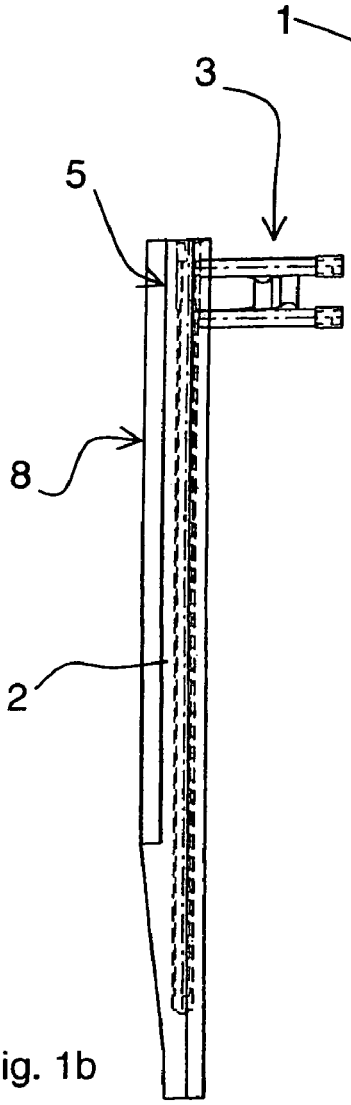
FIGS. 1*a*, 1*b* and 1*c* A cooling element according to the invention FIG. 2 The connecting of the cooling elements
Figure 1A:
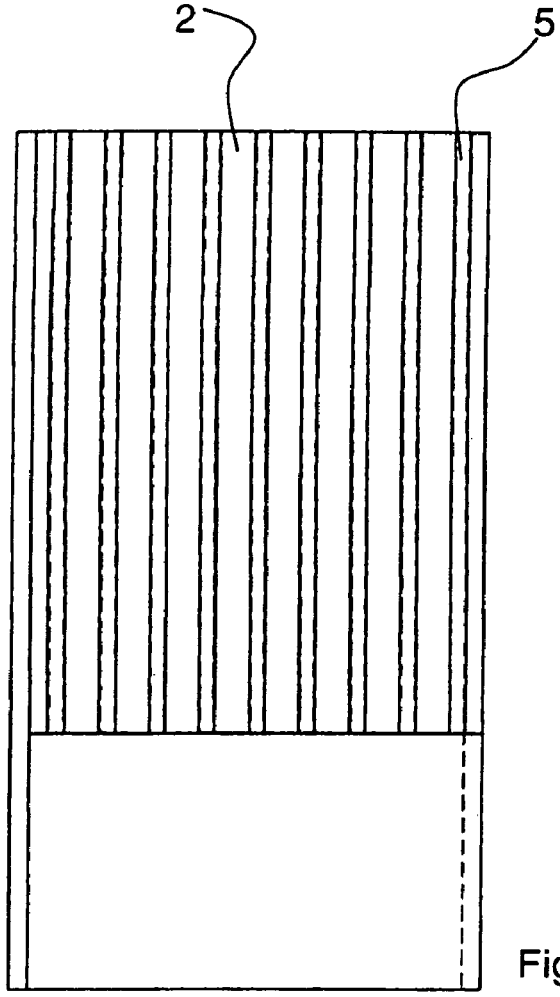
Figure 1C:
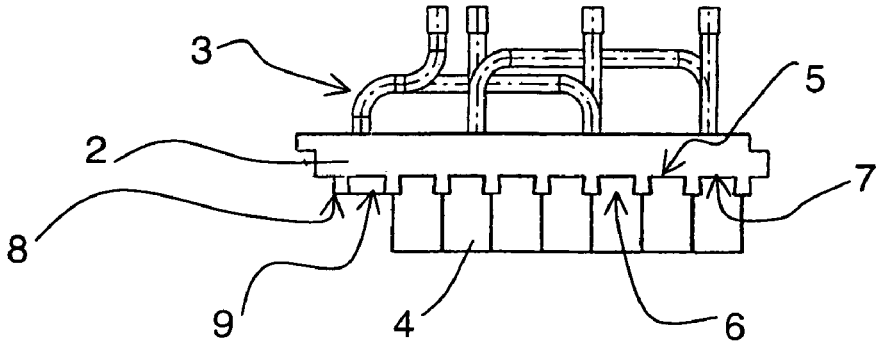

FIGS. 1*a*, 1*b* and 1*c* illustrate a cooling element 1 according to the invention, which is suited to be used for instance in the wall structure of a flash smelting furnace. FIG. 1*a* is a front-view illustration of the element, FIG. 1*b* is a side-view illustration and FIG. 1*c* a top-view illustration. The cooling element 1 comprises a copper housing 2 made of one single piece, in which a channel system 3 is formed for the circulation of the cooling medium. In addition, the cooling element comprises a sufficient number of lining elements 4 made of a fireproof material, such as chromium magnesite brick, which lining elements are connected to the housing 2. The housing and the lining elements are provided with elements for fastening them together. On the surface 8 of the housing, there are formed vertical grooves 5, in which the lining elements 4 are positioned in the vertical direction on top of each other, so that the whole groove is filled in the vertical direction of the cooling element within the area where the cooling element is in contact with the melt. The lining element 4 and the housing 2 are combined, so that the lining element 4 may move in the vertical direction with respect to the housing 2. Transversal movement cannot occur, because the grooves are positioned in the vertical direction. A good heat transfer is maintained between the lining element and the housing.

The lining element is provided with a bracket-like edge part 6 on the side where it is attached to the housing. The housing 2 has grooves 5, the shape of which conforms to the bracket-like edge parts 6 provided in the lining element, so that the grooves are narrowed from the groove bottom 7 towards the surface 8 of the housing. The lining element 4 is connected to the copper housing 2 so that the edge parts 6 of the lining element are set in the housing grooves 5. This means that the lining elements are securely attached to the housing. According to an example, the width of the groove bottom 7 is essentially 74 millimeters, the width of the groove orifice 9 is essentially 68 millimeters and the groove depth is essentially 36 millimeters. By using these dimensions, there is achieved a cooling element that is functional and advantageous from the production technical point of view.

Figure 2:
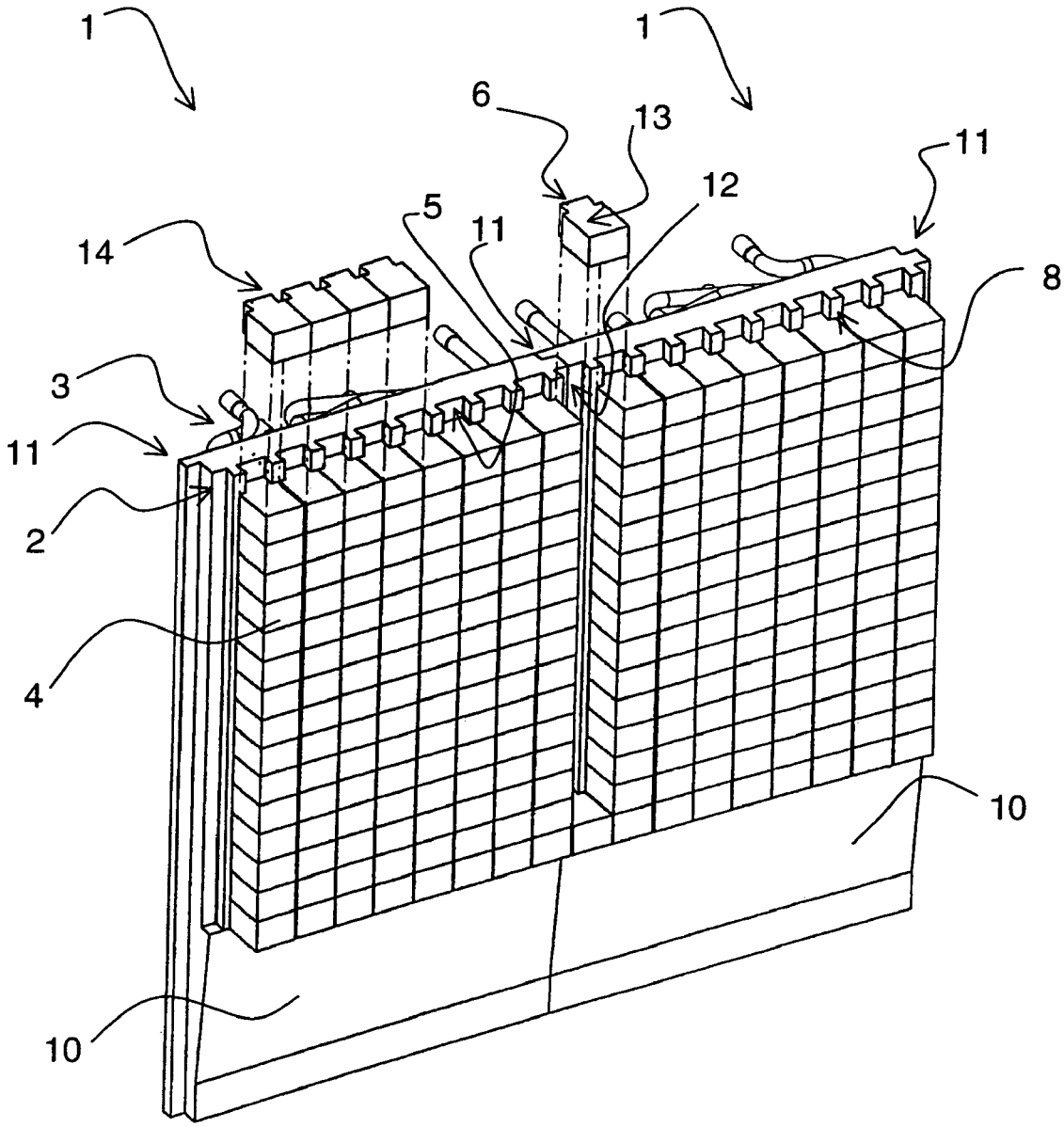

In FIG. 2, there is illustrated the connecting of separate cooling elements 1. A cooling element 1 is placed in the furnace so that the grooves 5 are positioned in the vertical direction. The bottom part 10 of a housing according to the example is narrowed downwards. Thus it preferably conforms to the shape of the supporting brick placed on the settler bottom. The bottom part of the housing does not get into contact with the melt, wherefore it does not have a fireproof lining. According to the example, the lining elements 4 are connected to the housing 2 before the cooling element is installed in the furnace. This procedure speeds up the installation process, as an element that is already compiled is installed in the supporting structure of the furnace. The cooling element can also be installed in the furnace so that the housing is first installed in the furnace structure, and the lining elements are connected thereto after this. In the depth direction, the lining elements 4 of the cooling element extend to outside the housing 2. Moreover, the lining elements 4 cover the whole surface 8 of the housing that gets into contact with the melt. Thus their insulating effect is improved, and the surface of the copper housing does not get into direct contact with the melt. The separate cooling elements are interconnected at the junctions 11 located in the elements, which means that when necessary, there can be created a structure that is as wide as the whole furnace wall. When connecting the separate cooling elements together, there is created, owing to the shape of the junctions 11, an auxiliary groove 12 that in shape conforms to the shape of the bracket-like edge part 6 of the lining element. Thus the seam between the cooling elements is advantageously covered by auxiliary lining elements 13. After fastening the separate cooling elements together, the topmost lining elements 14 are placed in the vertical grooves 5. They can also be installed in place already at an earlier stage.

For a man skilled in the art, it is obvious that the various preferred embodiments of the invention are not restricted to the examples described above, but may vary within the scope of the appended claims.

The invention claimed is;

1. A method for manufacturing a cooling element to be used in the structure of a flash smelting furnace, a blast furnace, an electric furnace or other metallurgical reactor, said cooling element comprising a copper housing made of one single piece, in which housing there is formed a channel system for circulation of cooling medium, one or more lining elements made of fireproof material, the method comprising connecting the one or more lining elements and the housing so that the one or more lining elements are movable in the vertical direction with respect to the housing in response to thermal expansion during operation of said furnace or reactor.

2. A method according to claim 1, further comprising in the surface of the housing, arranging one or more vertical grooves, in which one or more grooves the one or more lining elements are placed.

3. A method according to claim 2 further comprising in the one or more lining elements, arranging a bracket-like edge part that fits in the one or more grooves.

4. A method according to claim 2, further comprising in the one or more grooves, placing the one or more lining elements along the whole width of the one or more grooves, so that the one or more lining elements are located on top of each other.

5. A method according to claim 2, further comprising narrowing the one or more grooves from the groove bottom towards the surface of the housing.

6. A method according to claim 2, wherein the width of the groove bottom is essentially 55-100 millimeters.

7. A method according to claim 2, wherein the width of the groove orifice is essentially 50-95 millimeters.

8. A method according to claim 2, wherein the depth of the groove is essentially 30-60 millimeters.

9. A method according to claim 2, further comprising placing the cooling element in the furnace so that the one or more grooves are positioned in the vertical direction.

10. A method according to claim 2, further comprising narrowing the bottom part of the housing downwards.

11. A method according to claim 1, further comprising connecting the one or more lining elements to the housing before the cooling element is installed in the furnace.

12. A method according to claim 1, further comprising connecting the one or more lining elements to the housing after the housing is installed in the furnace.

13. A method according to claim 1, further comprising in the depth direction of the cooling element, extending the one or more lining elements to outside the housing.

14. A method according to claim 1, further comprising completely covering with the one or more lining elements the surface of the housing to be contacted with a melt in the furnace.

15. A method according to claim 1, further comprising interconnecting two or more cooling elements at one or more junctions provided between the two or more cooling elements.

16. A method according to claim 15, further comprising in the auxiliary groove formed at the one or more junctions, placing one or more lining elements in the vertical direction.

17. A cooling element to be used in the structure of a flash smelting furnace, a blast furnace, an electric furnace or other metallurgical reactor, said cooling element comprising a copper housing made of one single piece, in which housing there is formed a channel system for circulation of cooling medium, and further comprising one or more lining elements made of fireproof material, said housing and one or more lining elements being connected together, and the one or more lining elements and the housing being connected so that the one or more lining elements are movable in the vertical direction with respect to the housing in response to thermal expansion during operation of said furnace or reactor.

18. A cooling element according to claim 17, wherein the surface of the housing comprises one or more vertical grooves, in which the one or more lining elements are placed.

* * * * *